US009051736B2

(12) United States Patent
Geels et al.

(10) Patent No.: US 9,051,736 B2
(45) Date of Patent: Jun. 9, 2015

(54) WALL SYSTEM

(71) Applicant: MASCO BATH CORPORATION, Moorestown, NJ (US)

(72) Inventors: Michael Glenn Geels, Jackson, TN (US); Joanne Torcivia, Moorestown, NJ (US); Dane Hyatt Carswell, Abington, PA (US); Jeffery John Mathison, Chicago, IL (US)

(73) Assignee: Delta Faucet Comopany, Indianapolis, IN (US)

( * ) Notice: Subject to any disclaimer, the term of this patent is extended or adjusted under 35 U.S.C. 154(b) by 0 days.

(21) Appl. No.: 13/958,697

(22) Filed: Aug. 5, 2013

(65) Prior Publication Data

US 2015/0033656 A1 Feb. 5, 2015

(51) Int. Cl.

| | |
|---|---|
| ***E04F 13/09*** | (2006.01) |
| ***E04B 2/00*** | (2006.01) |
| ***E04F 13/08*** | (2006.01) |
| *A47K 3/16* | (2006.01) |

(52) U.S. Cl.

CPC ..... *E04C 2/46* (2013.01); *E04F 13/0803* (2013.01); *E04F 13/0826* (2013.01); *E04F 13/0862* (2013.01); *A47K 3/16* (2013.01)

(58) Field of Classification Search

CPC ..... E04F 13/0803; E04F 13/0826; E04F 13/0862; A47K 3/008

USPC ..... 52/35, 384–387, 506.05, 506.06, 509; 4/612–614

See application file for complete search history.

(56) References Cited

U.S. PATENT DOCUMENTS

| | | | | |
|---|---|---|---|---|
| 3,996,703 | A | 12/1976 | Daniels | |
| 4,316,295 | A | 2/1982 | Whitney et al. | |
| 4,471,501 | A | 9/1984 | Heymann | |
| 4,578,832 | A | 4/1986 | Primucci | |
| 4,671,026 | A | 6/1987 | Wissinger | |
| 4,691,392 | A | 9/1987 | Whitney | |
| 4,817,344 | A | 4/1989 | Wissinger | |
| 4,825,480 | A | 5/1989 | Moore | |
| 4,893,450 | A * | 1/1990 | Donaldson et al. | 52/35 |
| 4,901,380 | A | 2/1990 | Smith | |
| 4,947,608 | A * | 8/1990 | Donaldson et al. | 52/509 |
| 4,987,619 | A | 1/1991 | Smith | |
| 5,263,208 | A | 11/1993 | Smith | |
| 5,311,707 | A | 5/1994 | LaRoche et al. | |
| 5,473,843 | A | 12/1995 | LaRoche et al. | |
| 5,671,489 | A | 9/1997 | Salach | |
| 5,692,345 | A | 12/1997 | Mogaki et al. | |
| 6,098,364 | A * | 8/2000 | Liu | 52/506.08 |
| 6,202,377 | B1 * | 3/2001 | Krieger | 52/489.1 |

(Continued)

FOREIGN PATENT DOCUMENTS

| | | | | |
|---|---|---|---|---|
| DE | 4000951 A1 * | 2/1993 | | E04F 13/08 |
| EP | 0532827 A1 | 3/1993 | | |

*Primary Examiner* — Adriana Figueroa

(74) *Attorney, Agent, or Firm* — Carlson, Gaskey & Olds, PC

(57) ABSTRACT

A wall system includes at least one starter piece having at least one mount interface configured to be attached to a wall structure. A plurality of panels includes at least a first panel and a second panel, and wherein the first panel is fit to the starter piece to cover a portion of the wall structure. An intermediate cleat is associated with the first panel, and a second panel is interlocked to the first panel by the intermediate cleat to cover another portion of the wall structure.

30 Claims, 19 Drawing Sheets

(56) References Cited

U.S. PATENT DOCUMENTS

| | | | | |
|---|---|---|---|---|
| 6,425,147 | B1 | 7/2002 | Hanson | |
| 6,434,764 | B2 | 8/2002 | Primucci | |
| 6,508,449 | B2 | 1/2003 | Veazey | |
| 6,691,339 | B1 | 2/2004 | Thomas | |
| 7,424,754 | B2 | 9/2008 | Ingram et al. | |
| 7,712,277 | B2 * | 5/2010 | Swanson | 52/541 |
| 7,810,289 | B2 * | 10/2010 | Montgomery | 52/235 |
| 7,987,648 | B1 * | 8/2011 | Ryan | 52/506.06 |
| 8,069,506 | B2 | 12/2011 | Hammond | |
| 8,082,608 | B2 | 12/2011 | Dabrowski | |
| 8,166,716 | B2 * | 5/2012 | Macdonald et al. | 52/235 |
| 8,322,103 | B1 * | 12/2012 | Kownacki | 52/506.05 |
| 8,332,972 | B2 | 12/2012 | Bullis et al. | |
| 8,528,275 | B2 * | 9/2013 | Paananen | 52/155 |
| 8,567,140 | B2 * | 10/2013 | Wagner | 52/235 |
| 8,695,303 | B2 * | 4/2014 | Swanson | 52/553 |
| 2001/0010139 | A1 * | 8/2001 | De Kerpel et al. | 52/479 |
| 2003/0046891 | A1 * | 3/2003 | Colada et al. | 52/518 |
| 2006/0080939 | A1 * | 4/2006 | Bledsoe et al. | 52/750 |
| 2006/0179764 | A1 * | 8/2006 | Ito | 52/506.06 |
| 2008/0127406 | A1 | 6/2008 | Hammond | |
| 2010/0037387 | A1 | 2/2010 | Hoernig et al. | |
| 2010/0132295 | A1 * | 6/2010 | Bootier et al. | 52/520 |
| 2010/0263316 | A1 * | 10/2010 | Bruneau | 52/546 |
| 2012/0304573 | A1 * | 12/2012 | Aboukhalil | 52/506.05 |

* cited by examiner

WALL SYSTEM

BACKGROUND OF THE INVENTION

Certain bathing areas are surrounded by walls that are covered with tile to provide a desired appearance. Tiled walls offer the advantage of an aesthetically appealing appearance with the option of having many different style, color, texture, and/or pattern choices. However, installing tile is a time consuming and messy process. Further, when remodelling a bathroom, tearing out tile and installing new tile can be expensive.

Plastic bathing area surrounds provide a less expensive option for remodelling a bathroom. Typically, these surrounds are formed in one or more large sections that are secured together to cover the bathing area walls or to cover existing outdated tile. One disadvantage with these surrounds is that they are made from materials that are not as aesthetically appealing as tile.

It is desired to provide an alternative to tile that is easy to transport and simple to install, as well as providing the aesthetic options that are available for tile.

SUMMARY OF THE INVENTION

In one exemplary embodiment, a wall system includes at least one starter piece having at least one mount interface configured to be attached to a wall structure. A plurality of panels includes at least a first panel and a second panel, and wherein the first panel is fit to the starter piece to cover a portion of the wall structure. An intermediate cleat is associated with the first panel, and a second panel is associated with the first panel via the intermediate cleat to cover another portion of the wall structure.

In a further embodiment of the above, the first and second panels have decorative external surfaces that cooperate to form a desired aesthetic appearance for walls surrounding a bathing area.

In a further embodiment of any of the above, the starter piece comprises a starter strip that includes at least one first locating feature and the first panel includes at least one second locating feature that cooperates with the first locating feature to align the first panel and starter strip.

In a further embodiment of any of the above, wherein one of the first and second locating features comprises a tongue and the other of the first and second locating features comprises a groove.

In a further embodiment of any of the above, including at least one seal between the starter piece and the first panel.

In a further embodiment of any of the above, wherein the first panel includes a wall facing side and a visible decorative surface, and wherein an upper portion of the wall facing side has a cut-out such that a lower edge of the intermediate cleat is positioned between the wall structure and the upper portion of the first panel.

In a further embodiment of any of the above, wherein the second panel includes a wall facing side and a visible decorative surface, and wherein a lower portion of the wall facing side has a cut-out with an upper edge of the intermediate cleat being positioned between the bathroom wall and the lower portion of the second panel such that the visible decorative surfaces of the first and second panels are aligned with each other.

In a further embodiment of any of the above, the plurality of panels cooperate with each other to cover the bathroom walls that surround a bathing area. The plurality of panels includes at least one uppermost panel. A finishing cleat is fit to the uppermost panel and a horizontal trim piece fits to the uppermost panel and covers the finishing cleat.

In a further embodiment of any of the above, the plurality of the panels are aligned to provide at least one exposed vertical edge. At least one vertical trim piece is coupled to at least one of the plurality of panels that form the vertical edge, and the vertical trim piece abuts against the horizontal trim piece and covers the exposed vertical edge.

In a further embodiment of any of the above, the walls include a rear wall and at least one side wall that intersects the rear wall at a corner. The plurality of panels includes at least one first corner panel covering a portion of the rear wall and a second corner panel covering a portion of the side wall. At least one corner piece is fit within the corner and abuts against the first and second corner panels.

In a further embodiment of any of the above, the at least one starter piece comprises at least one first starter strip associated with the rear wall and a second starter strip associated with the side wall. An intermediate starter strip corner piece fits within the corner and abuts against the first and second starter strips.

One exemplary method of covering walls that surround an area includes installing at least one starter piece, fitting at least one first panel of a plurality of panels to the starter piece to cover a portion of a wall structure, associating an intermediate cleat with the first panel, and associating at least one second panel of the plurality of panels with the intermediate cleat and first panel to cover another portion of the wall structure.

In a further embodiment of any of the above, the method further includes installing at least one horizontal trim piece to cover an exposed uppermost edge formed by the plurality of panels.

In a further embodiment of any of the above, the method includes installing at least one vertical trim piece to cover an exposed vertical edge formed by the plurality of panels.

In another example embodiment, a wall panel for an area enclosed by a plurality of walls includes a panel body having a wall facing surface and an exterior surface that faces the area. The walls provide an area defined by an overall vertical wall height and an overall horizontal wall width, and wherein the panel body is sized to cover only one vertical segment of the overall vertical wall height. Decorative features are formed within the exterior surface to provide a desired appearance. A lower portion of the panel body interfaces with a lower seal and an upper portion of the panel body interfaces with an upper seal.

An example method for forming a wall panel includes forming a panel body to have a desired appearance, In one example, the panel body is sized to form one of a plurality of planks or the panel body is cut to form a plurality of planks each having an upper portion and a lower portion. The upper portion is configured to have an upper seal interface and the lower portion is configured to have a lower seal interface.

These and other features of this application will be best understood from the following specification and drawings, the following of which is a brief description.

DETAILED DESCRIPTION

Figure 1:
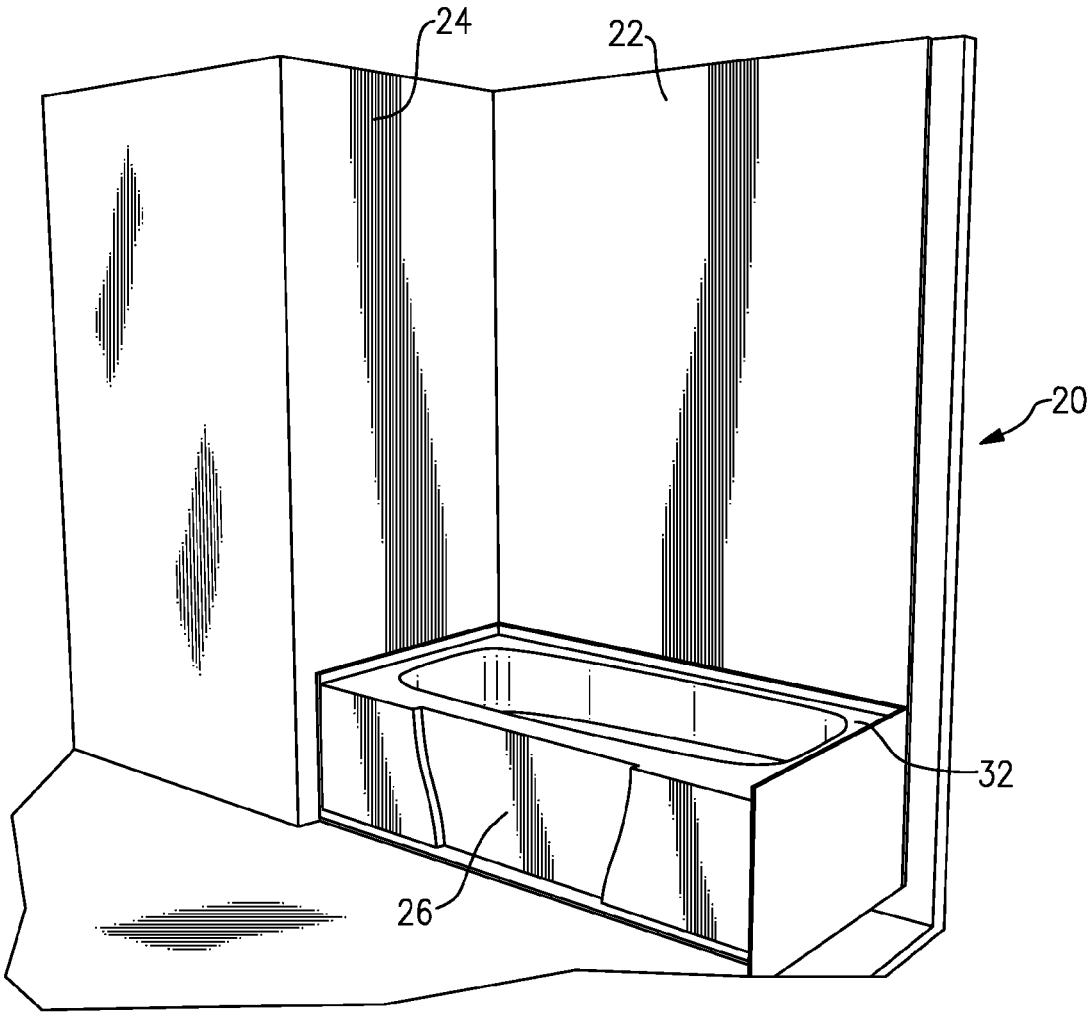
FIG. 1 is a perspective view of a bathing area including a tub, a rear wall, and one side wall.
Figure 16:
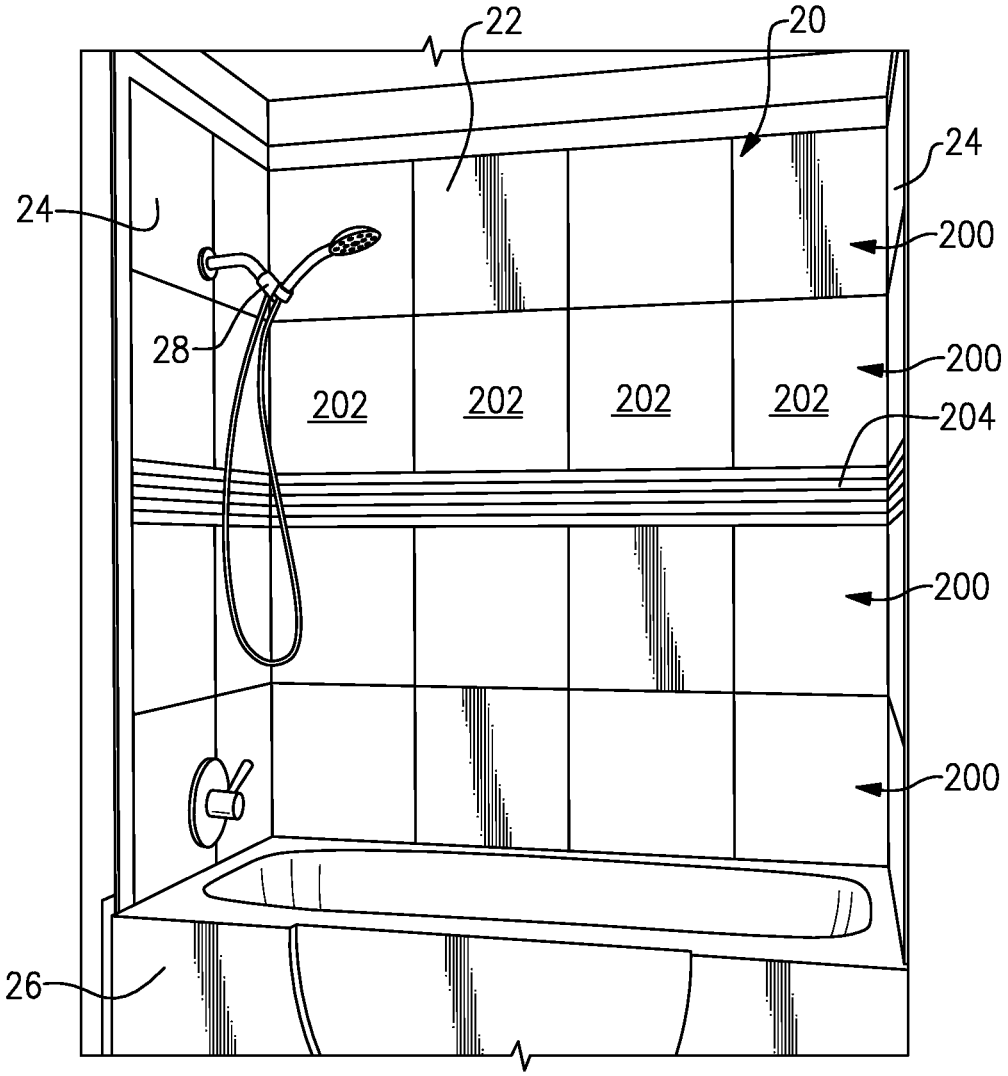
FIG. 16 is a view similar to FIG. 14 but showing both side walls and a shower.

FIG. 1 shows one example of a bathing area 20 that is surrounded by a rear wall 22 and side walls 24. FIG. 1 only shows one of the side walls 24 for purposes of clarity; however, FIG. 16 shows both side walls 24. In this example, the bathing area includes a tub 26 resting on a floor and a shower spout 28 (FIG. 16); however, the bathing area 20 may also be configured solely as a shower or solely as a tub. Further, the bathing area could comprise any of various known shower and/or tub configurations including corner showers, step up tubs, zero entry showers, etc. A system of interlocking planks or panels is used to cover the rear 22 and side 24 walls to provide a desired aesthetic appearance for the bathing area 10. This will be discussed in greater detail below.

The rear 22 and side 24 walls are prepped and waterproofed as known. Then as shown in FIGS. 2A-2D and 3, a starter piece, such as a starter strip 30 for example, is installed to extend along an upper ledge 32 of the tub 26. The starter strip 30 can either come in standard set lengths, or can be cut to a desired length on site. Further, the starter strip 30 can comprise a separate piece or could be formed as part of a tub ledge when used with a tub configuration. Also, the starter strip 30 may not include openings and the fasteners could instead penetrate the strip to create their own hole. Or, the starter strip could be glued to the wall after being leveled, and not require any fasteners. Further, instead of comprising one long strip, the starter strip could be comprised of a series of shorter strip segments, or starter clips could be used.

Figure 2B:
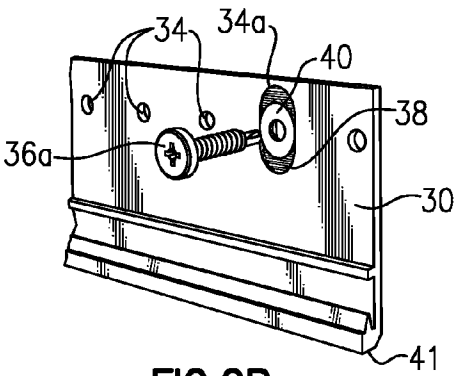
FIG. 2B is similar to FIG. 2B and additionally shows a fastener associated with the adjustment puck for an initial installation position.
Figure 2A:
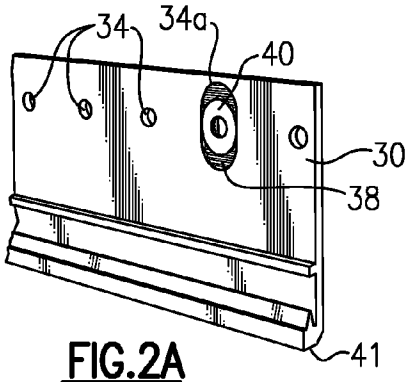
FIG. 2A is a front perspective view of one end of a starter strip and adjustment puck.

In the example shown, the starter strip 30 includes a plurality of openings 34 that are configured to receive fasteners 36. One opening 34*a* of the plurality of openings 34 is configured to be larger than the remaining openings 34. The opening 34*a* is surrounded by a toothed surface 38. An adjustment puck 40 with a mating toothed surface is pressed into engagement with the toothed surface 38 (FIG. 2A). The adjustment puck 40 includes a puck opening through which the associated fastener 36 can extend. The puck opening is aligned with the larger opening 34*a*.

Figure 2C:
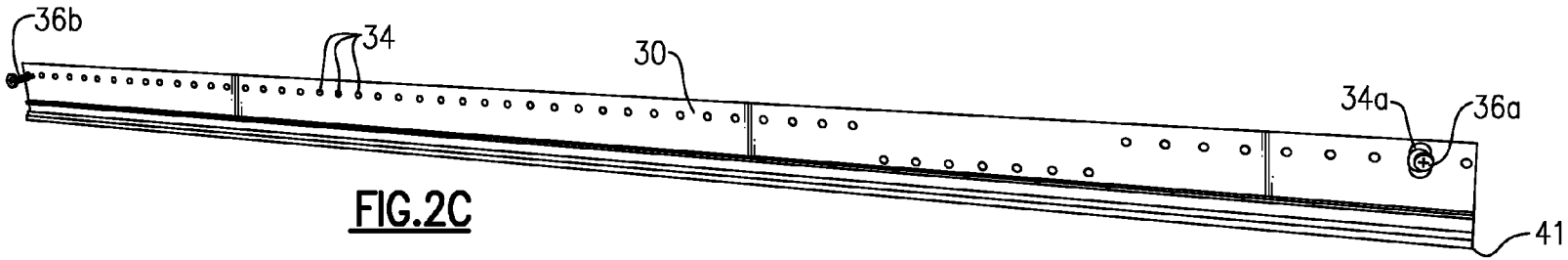
FIG. 2C is a front perspective view of the starter strip of FIG. 2A extending between first and second ends.
Figure 2D:
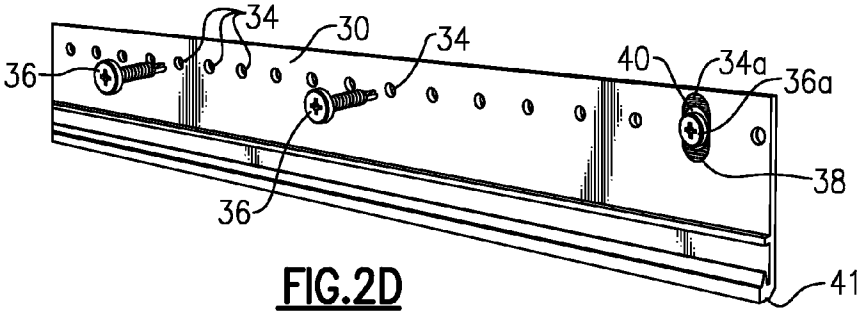
FIG. 2D is a view similar to FIG. 2B but includes additional fasteners for a final installation position.

First, the starter strip 30 is positioned such that a bottom edge 41 rests on the upper ledge 32 of the tub 26. A first fastener 36*a* is inserted through the aligned puck opening and starter strip opening 34*a* to provide an initial temporary hold for the starter strip 30 (FIG. 2B) to the wall. Next, a second fastener 36*b* is inserted through an opening 34 at an opposite end of the starter strip 30 from the adjustment puck 40 (FIG. 2C). This allows an installer to fine tune the starter strip 30 into a level position, i.e. the installer taps the starter strip 30 into a final position that is level along the length of the starter strip 30 (FIG. 2C). The installer lightly taps the starter strip 30 such that the teeth on the adjustment puck 40 ratchet over the toothed surface 38 on the starter strip until the starter strip 30 has achieved a level position. Finally, the remaining fasteners 36 are installed through the remaining openings 34 as needed to hold the starter strip 30 firmly in place (FIG. 2D).

Figure 3:
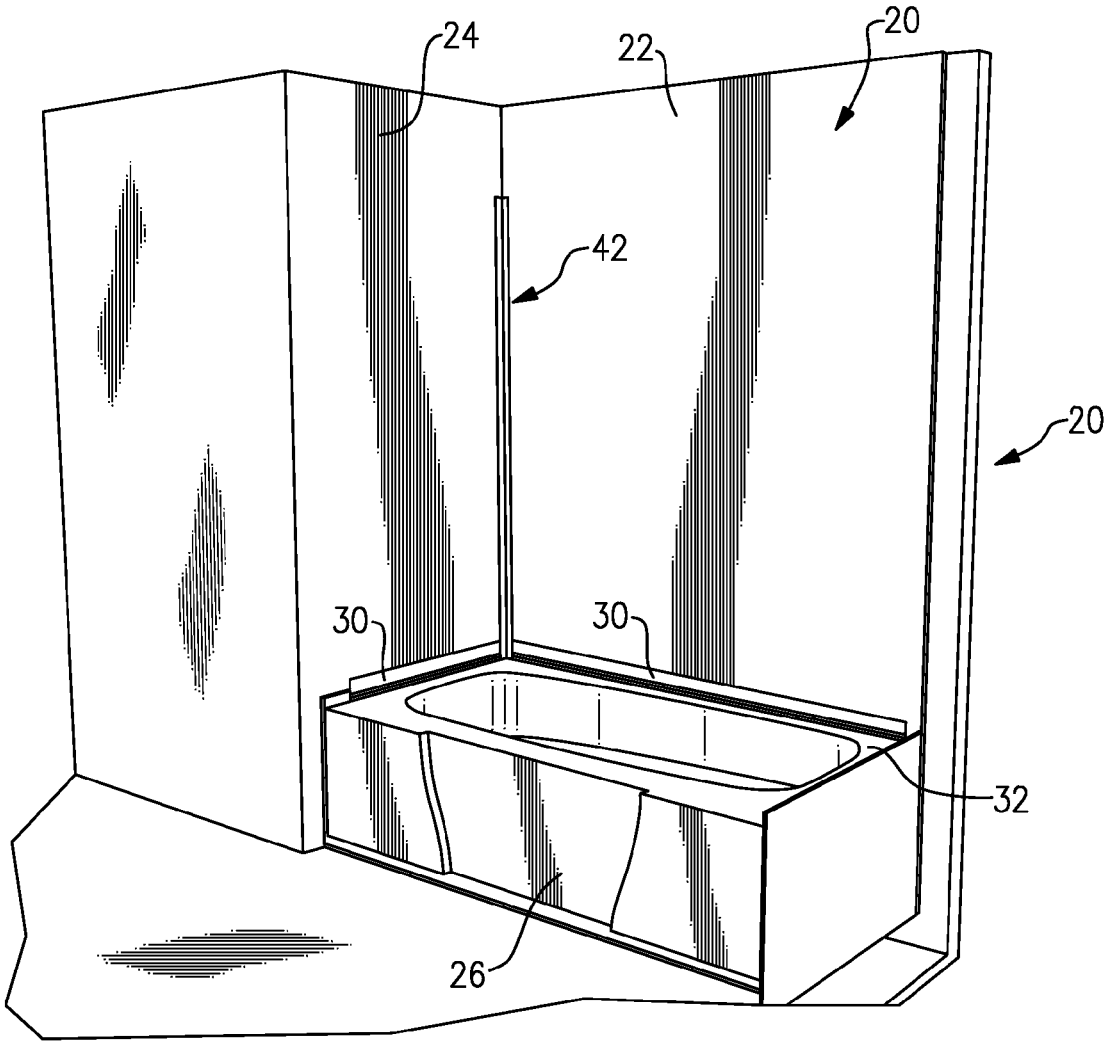
FIG. 3 is a view similar to FIG. 1 but with the starter strips and corner details installed.
Figure 4A:
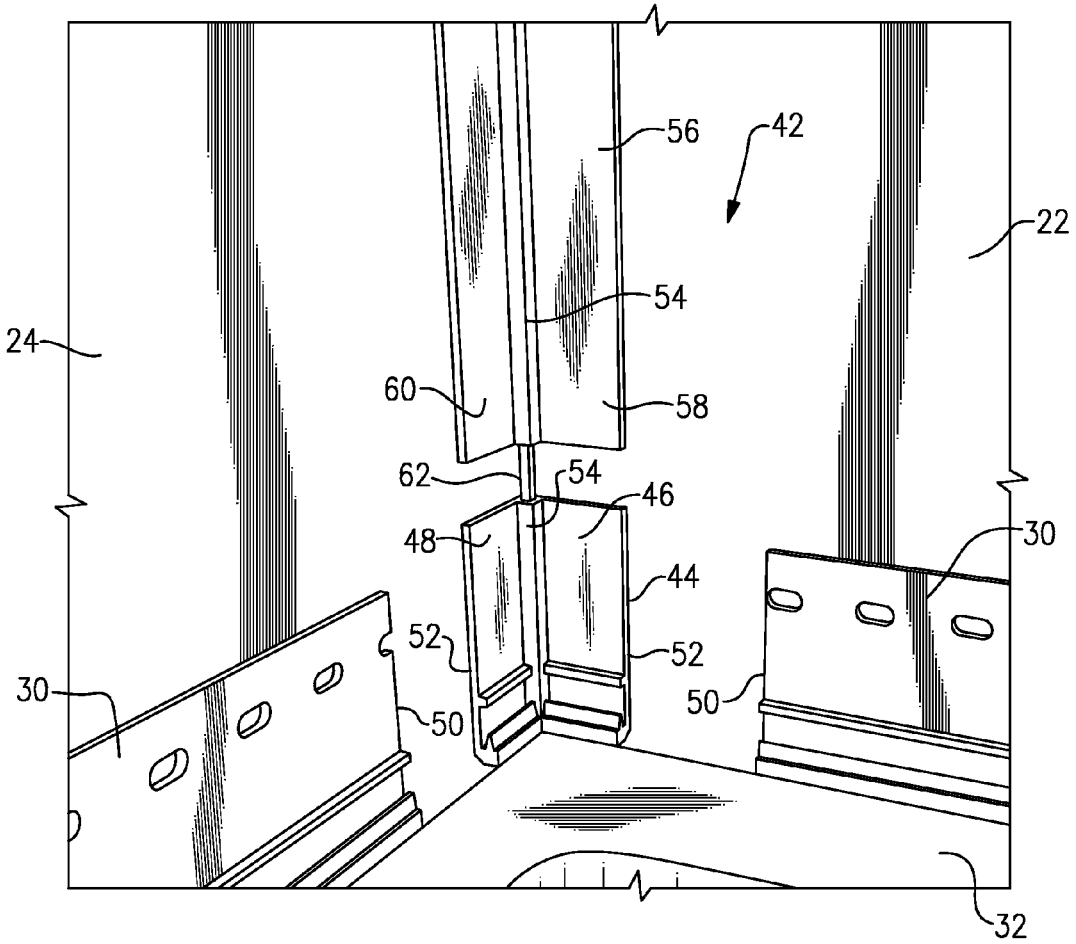
FIG. 4A is an exploded view of one example of a corner detail comprising a box-shape.
Figure 4B:
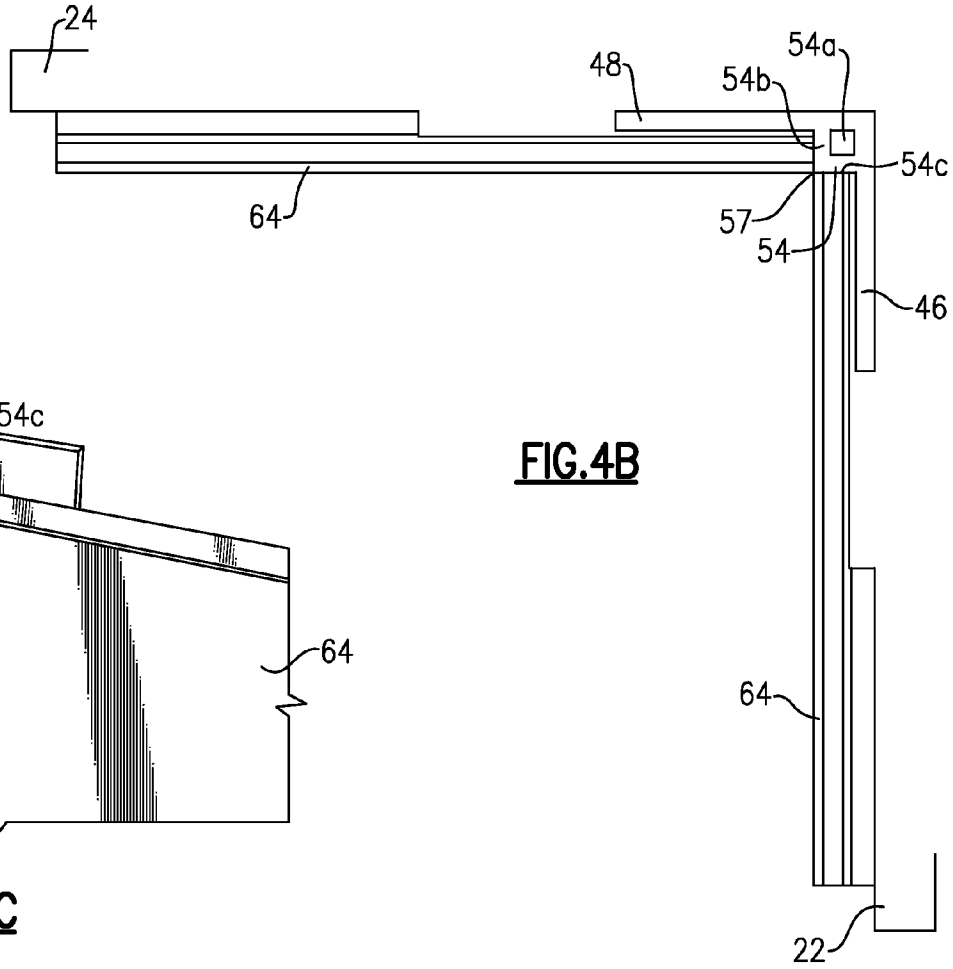
FIG. 4B is a top view of the corner detail of FIG. 4A as installed between two intersecting corner panels.
Figure 4C:
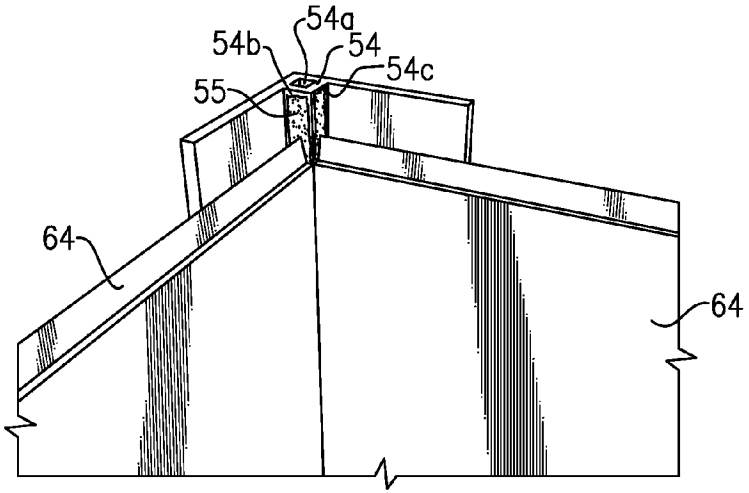
FIG. 4C is a perspective view of FIG. 4B.

Once the starter strip 30 along the rear 22 and side 24 walls is installed as shown in FIG. 3, a corner piece assembly 42 is used to fill the void area where the rear and side wall starter strips 30 intersect. The configuration shown in FIGS. 4A-4C is an example of a "box-style" corner piece. In this example, the corner piece assembly 42 includes at least an intermediate starter strip corner piece 44 that fits between the starter strip 30 on the rear wall 22 and the starter strip 30 on the side wall 24. In one example shown in FIG. 4A, the intermediate starter strip corner piece 44 has a first wall portion 46 flush with the starter strip 30 of the rear wall 22 and a second wall portion 48 flush with the starter strip 30 of the side wall 24. Edges 50 of the starter strip 30 abut against edges 52 of the intermediate starter strip corner piece 44.

The first 46 and second 48 wall portions intersect each other at a box-shaped corner section 54 that includes a vertically extending bore 54*a* (FIG. 4B). The bore 54*a* can be formed to have various shapes; however, in the example shown in FIG. 4A-C, the bore 54*a* has a square or box shape. The corner piece assembly 42 includes one or more additional corner pieces 56 that are fit together to fill the remaining portion of the corner as shown in FIG. 3. The additional corner pieces 56 have first 58 and second walls 60, and are fit to abut against fastening cleats on the rear 22 and side 24 walls respectively. This will be discussed in greater detail below. In one example, the additional corner piece 56 includes an extension portion 62 that fits into the bore 54*a* in the intermediate starter strip corner piece 44 to fix the additional corner piece 56 to the intermediate starter strip corner piece 44. The extension portion 62 could optionally be formed on the starter strip corner piece 44 to be inserted into the additional corner piece 56. The additional corner piece 56 also includes the box-shaped corner piece 54 as described above. The corner piece assembly 42 is just one example of a corner detail, other corner piece configurations could also be used as will be discussed in further detail below.

Once the starter strips 30 and corner piece assembly 42 is installed for the rear 22 and side 24 walls as shown in FIG. 3, a series of decorative panels 64 are then installed to cover the rear 22 and side 24 walls. The decorative panels 64 can be precut to standard lengths, or the walls can be measured and the panels 64 can be cut to the desired length on site. The decorative panels can provide a wide variety of decorative appearance options. The panels 64 are configured to provide the appearance of stone, tile, granite, marble, etc. in various different colors and patterns. The panels 64 provide exterior surfaces that are smooth or textured, and can also include accent strips having different styles, colors, patterns, etc.

Figure 5:
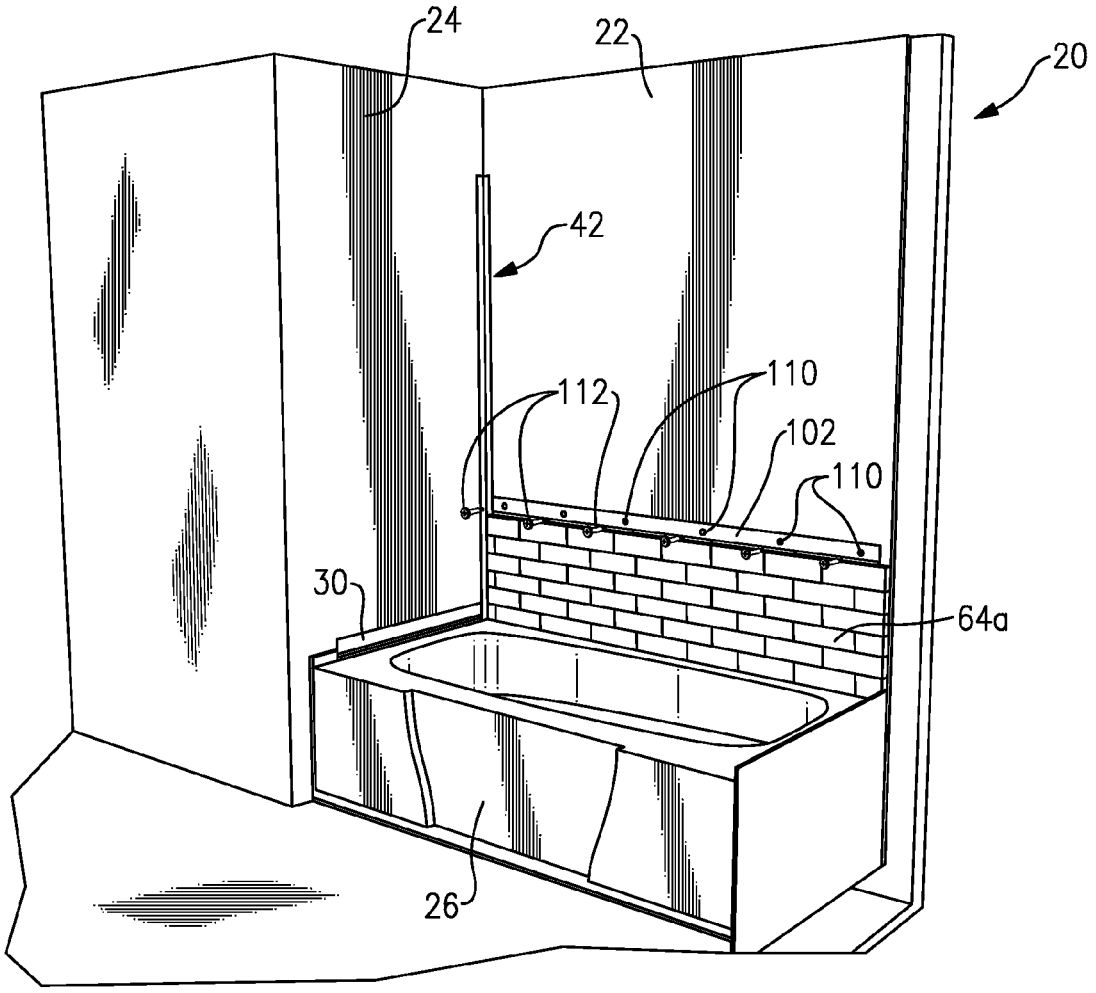
FIG. 5 is a view similar to FIG. 3 but additionally shows a first panel installed along a rear wall starter strip.
Figure 6:
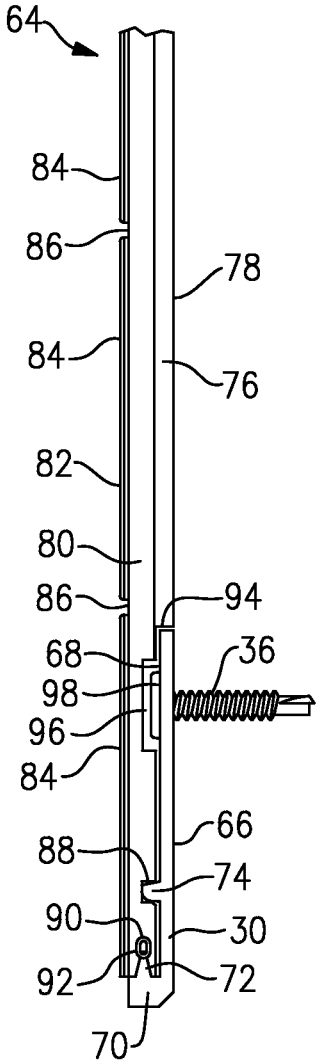
FIG. 6 is a side view showing a connection interface between a starter strip and a wall panel.

FIG. 5 shows the bathing area 20 with a first panel 64*a* installed on the starter strip 30 to cover a portion of the rear wall 22. The connection interface between the panel 64*a* and starter strip 30 is shown in greater detail in FIG. 6. The starter strip 30 includes a wall facing side 66 and a front facing side 68. The starter strip 30 includes a lip 70 that forms a bottom edge 41 that rests along the upper surface of the ledge 32 of the tub 26. A projection or protrusion 72 extends vertically upwardly from the lip 70. A rib 74 is formed to extend outwardly from the front facing side 68 of the starter strip 30. An upper portion of the starter strip 30 includes the openings 34 that receive the fasteners 36. The rib 74 is positioned vertically between the openings 34 and the protrusion 72.

The panel 64 includes a panel substrate 76 that provides the structural integrity for the panel 64 and which defines a wall facing side 78 for the panel 64. A decorative portion 80 of the panel 64 is attached to the substrate 76 and defines the visible, decorative exterior surface 82 of the panel 64. In the example, shown in FIG. 6, the decorative exterior surface of the panel 64 includes tile portions 84 that are separated by gaps 86 to provide the appearance of grouted tile.

The wall facing side 78 of the panel 64 includes a groove 88 that is configured to receive the rib 74 of the starter strip 30. A bottom edge of the panel 64 includes a recess 90 that is configured to receive the protrusion 72 of the starter strip 30. A seal or gasket 92 is installed and compressed against surfaces defined by the recess 90 as the protrusion 72 is inserted into the recess 90. The gasket 92 provides an added level of water ingress protection. Optionally, the seal could be located anywhere along the interface, or the protrusion itself could serve as the seal.

A lower end of the wall facing side 78 of the panel 64 also includes a cut-out portion 94 within which the starter strip 30 fits. A bottom edge of the panel 64 rests on an upper surface of the lip 70 such that the wall facing side 78 of the panel 64 and the wall facing side 66 of the starter strip 30 are generally flush with each other. An additional cut-out portion 96 is also formed within the panel 64 to accommodate a head 98 of the fastener 36.

Figure 7:
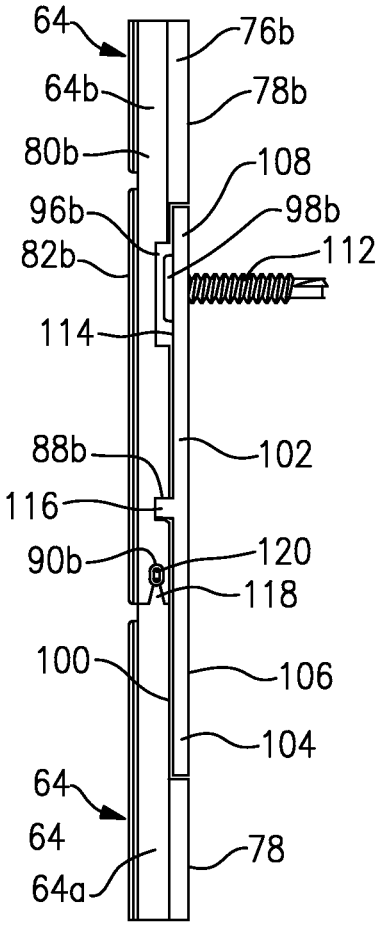
FIG. 7 is a side view showing a connection interface between adjacent wall panels and a cleat.
Figure 8:
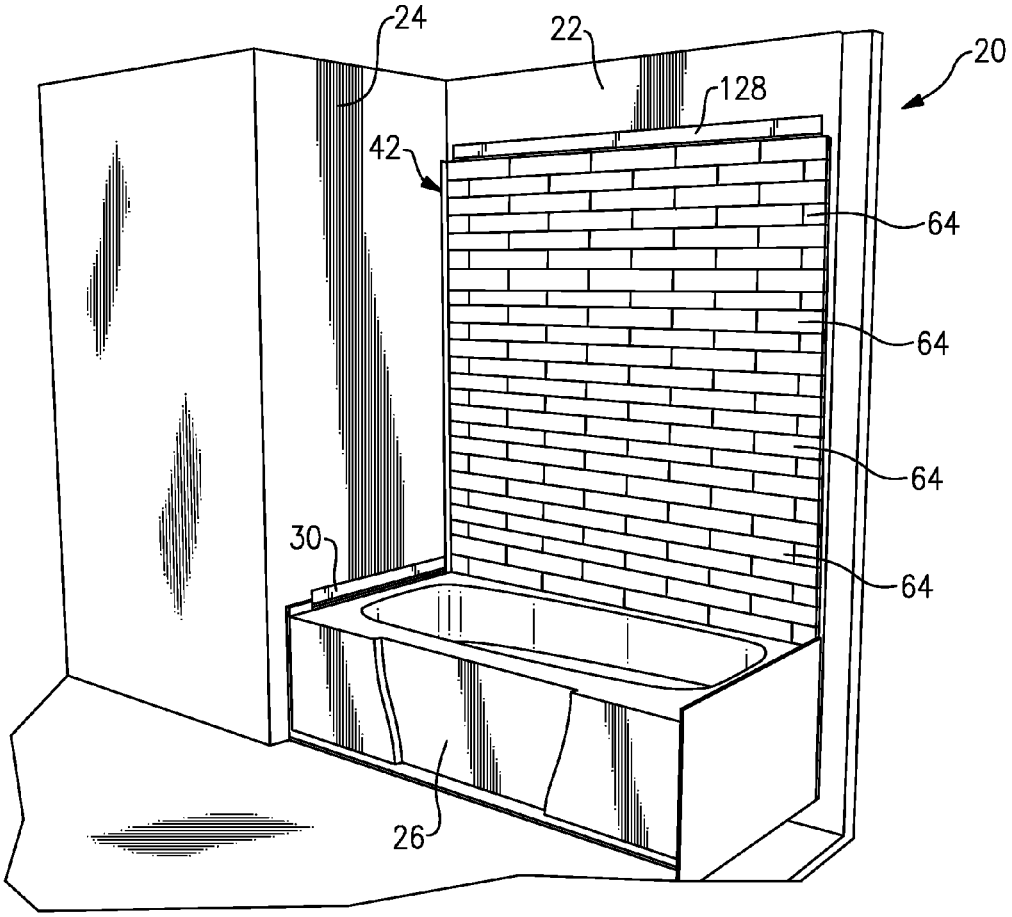
FIG. 8 is a view similar to FIG. 5 but additionally shows complete panel coverage for the rear wall.

Once the first panel 64 is installed to cover a first portion of the rear wall 22, additional panels 64 are added until the specified area of the rear wall 22 is covered (FIG. 8). As shown in FIG. 7, the upper end of the wall facing side 78 of the first panel 64 includes a cut-out 100. An intermediate cleat 102 is installed such that a bottom portion 104 of the cleat 102 is fit within the cut-out 100 such that a wall facing side 106 of the cleat 102 is generally flush with the wall facing side 78 of the panel 64. An upper portion 108 of the cleat 102 extends upwardly from a top edge of the first panel 64 (FIG. 5). The upper portion 108 includes a plurality of openings 110 for fasteners 112 (FIG. 5). Optionally, the cleat 102 may not include openings and the fasteners could instead penetrate the cleat to create their own hole. Or, the cleat could be glued to the wall and not require any fasteners. A front facing side 114 of the cleat 102 includes a rib 116.

FIG. 7 shows the connection interface between the first panel 64*a* and a second panel 64*b*. The second panel 64*b* is similarly constructed as the first panel 64*a* and includes a panel substrate 76*b* that provides the structural integrity for the panel 64*b* and which defines a wall facing side 78*b*. A decorative portion 80*b* of the second panel 64*b* is attached to the substrate 76*b* and defines the visible, decorative exterior surface 82*b*. The decorative exterior surface 82*b* of the second panel 64*b* can be the same as the first panel 64*a*, or can be different to provide a desired pattern or accent tile effect.

The wall facing side 78*b* of the second panel 64*b* includes a groove 88*b* that is configured to receive the rib 116 of the intermediate cleat 102. A bottom edge of the second panel 64*b* includes a recess 90*b* that is configured to receive a protrusion 118 formed on an upper edge of the first panel 64*a*. A gasket 120 is installed and compressed against surfaces defined by the recess 90*b* as the protrusion 118 is inserted into the recess 90*b*. The gasket 120 provides an added level of water ingress protection. A lower end of the wall facing side 78*b* of the second panel 64*b* also includes a cut-out portion 94*b* within which the upper portion 108 of the cleat 102 fits. A bottom edge of the second panel 64*b* rests on an upper edge surface of the first panel 64*a*. An additional cut-out portion 96*b* is also formed within the second panel 64*h* to cover a head 98*b* of the fastener 112.

The first panel 64*a* fits on the cleat 102 and can be attached via thermally activated adhesive, ultra sonic welding, or solvent bonded, for example. The cleat 102 interlocks the two panels 64*a*, 64*b*. The cleat 102 can be formed as a separate extrusion, as part of the same extrusion of one of the panels, or a separate extrusion attached to the panels in a manner as discussed above.

During installation, the first panel 64 is aligned with, or between, respective corner piece assemblies 42 and is slid downwardly to lock into the starter strip 30. FIGS. 4B-4C show the interface between the corner piece assembly 42 and the intersecting corner panels 64 after the panels 64 have been installed. The box-shaped corner piece 54 includes a front facing wall 54*b* that abuts against the rearward edge of the panel 64 on the side wall 24. The box-shaped corner piece 54 includes a side facing wall 54*c* that abuts against a side edge of the panel on the rear wall 22. Adhesive, indicated at 55, can be applied to the walls 54*b*, 54*c* to aid in waterproofing the joint. Further, caulk 57 can also be added to provide extra sealing. This configuration facilitates aligning the panels and provides an additional sealing point.

Figure 9:
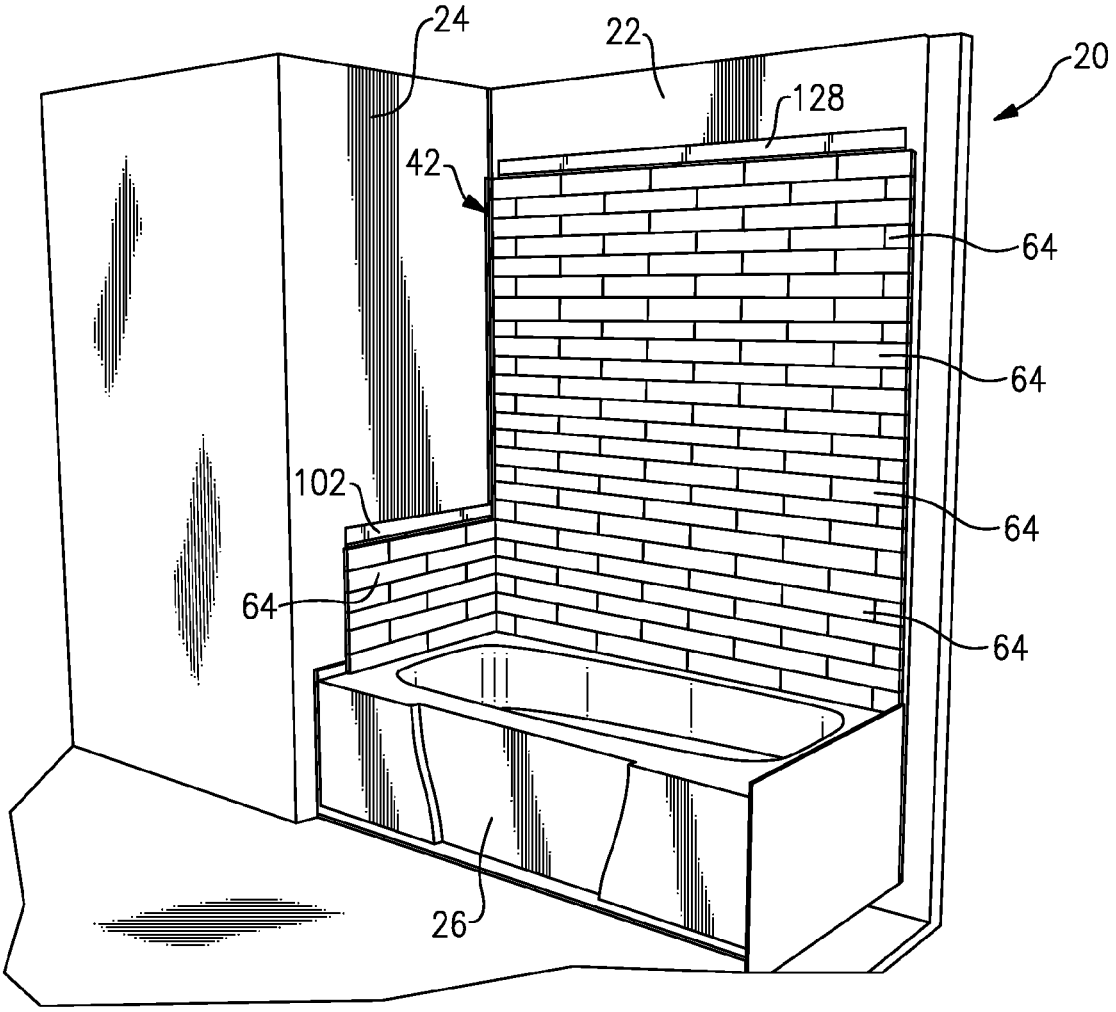
FIG. 9 is a view similar to FIG. 8 but additionally shows a first panel installed along a side wall starter strip.
Figure 10:
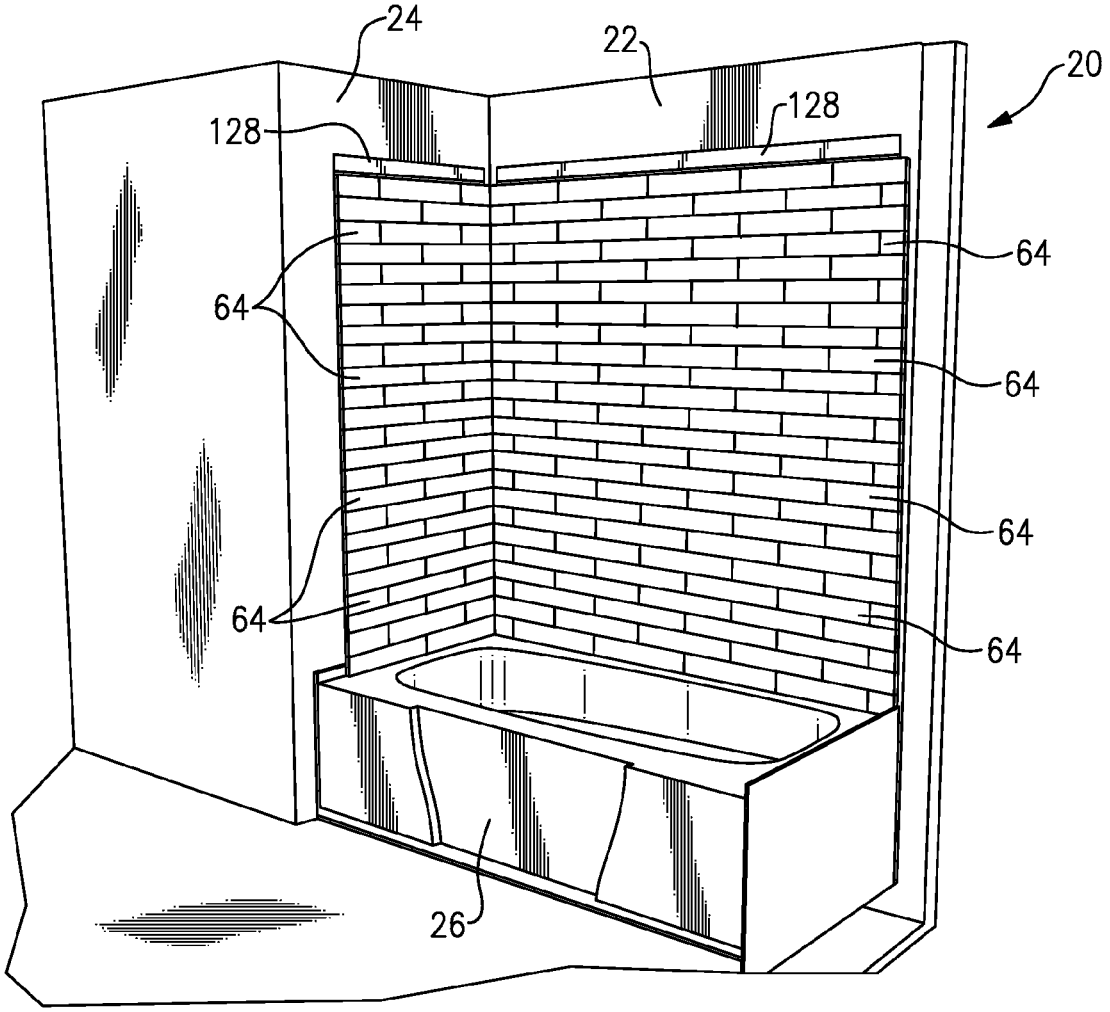
FIG. 10 is a view similar to FIG. 9 but additionally shows complete panel coverage for the side wall.
Figure 11:
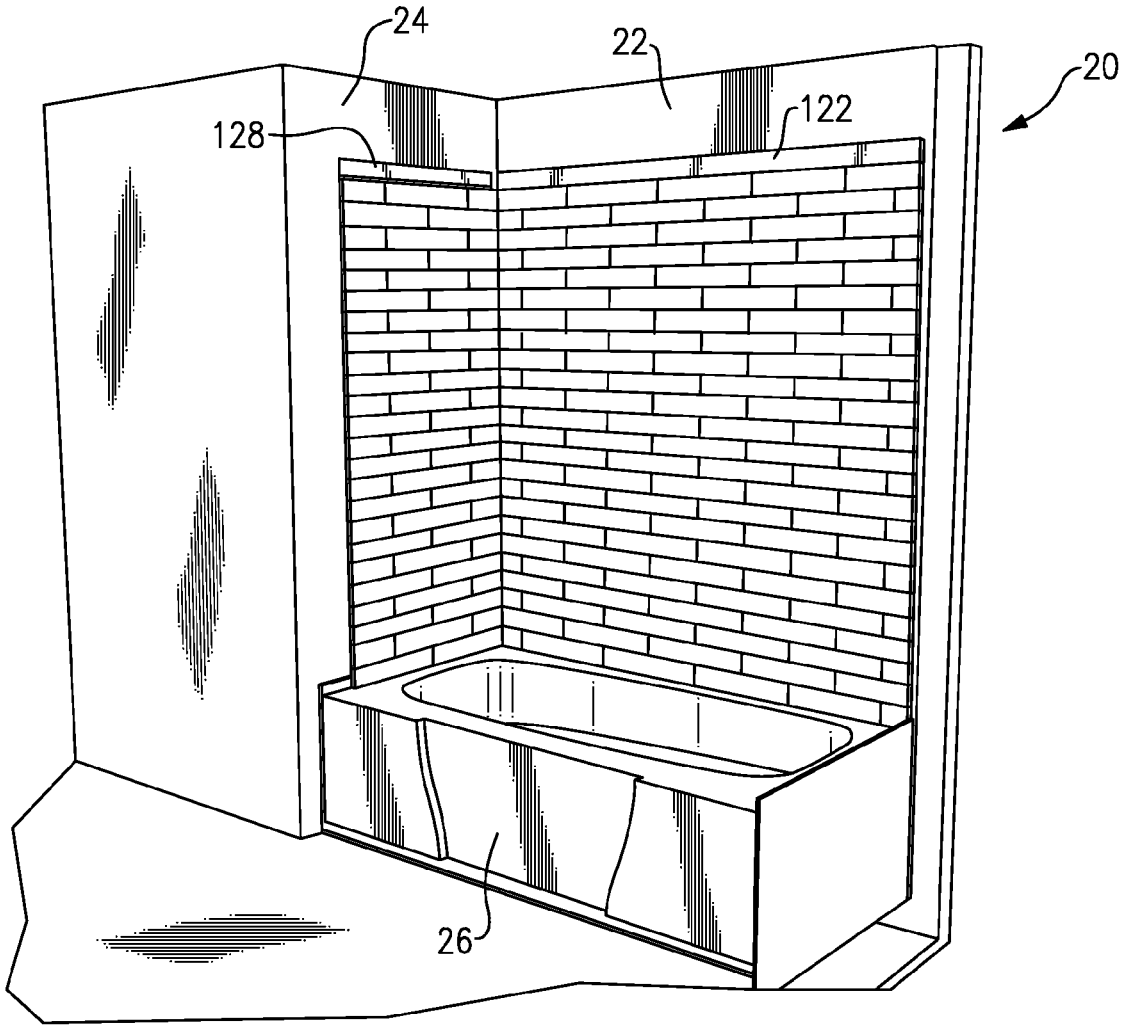
FIG. 11 is a view similar to FIG. 10 but additionally shows a horizontal trim piece along the rear wall.
Figure 12A:
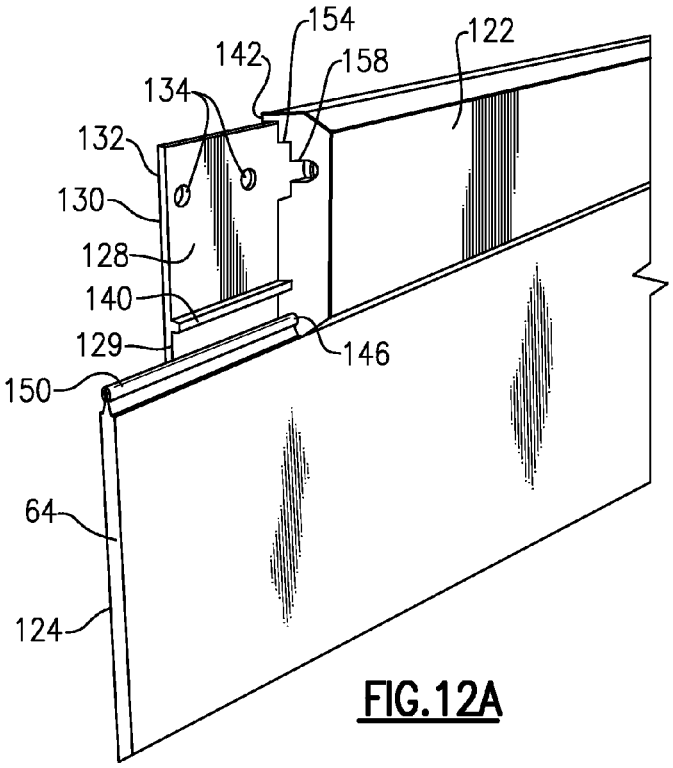
FIG. 12A is a front perspective view of a connection interface between a wall panel, finishing cleat, and horizontal trim piece.
Figure 12C:
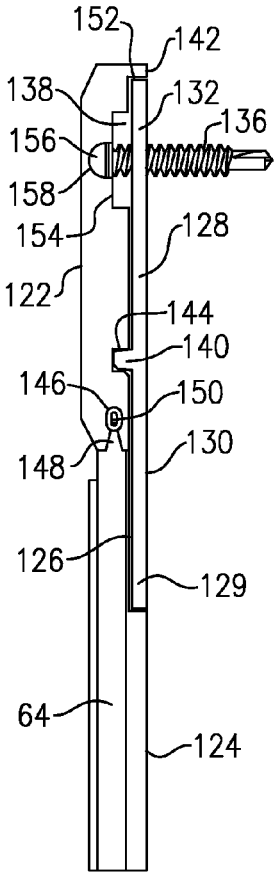
FIG. 12C is a side view of FIG. 12A showing the horizontal trim piece fully installed
Figure 12B:
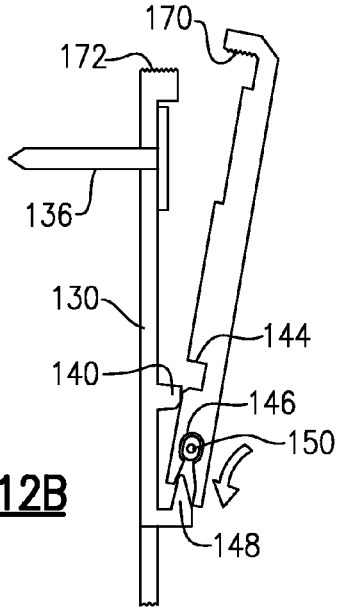
FIG. 12B is a side view showing an intermediate installation position of the horizontal trim piece.

Once the rear wall 22 is completely covered with panels 64 (FIG. 8), the same installation steps are done for the side walls 24 (FIG. 9) until the side walls 24 are completely covered as shown in FIG. 10. Next, as shown in FIG. 11, a horizontal trim piece or panel 122 is installed along an upper edge of the uppermost panel 64 extending along the rear wall 22. As shown in FIGS. 12A-12C, an upper end of a wall facing side 124 of the uppermost panel 64 includes a cut-out 126. A finishing cleat 128 is installed such that a bottom portion 129 of the cleat 128 is fit within the cut-out 126 such that a wall facing side 130 of the cleat 128 is generally flush with the wall facing side 124 of the uppermost panel 64. The finishing cleat 128 can be attached to the panel 64 in any of the various ways described above. An upper portion 132 of the cleat 128 extends upwardly from a top edge of the uppermost panel 64 as shown in FIGS. 12A-C. The upper portion 132 includes a plurality of openings 134 for fasteners 136. A front facing side 138 of the cleat 128 includes a rib 140.

A wall facing side 142 of the trim panel 122 includes a groove 144 that is configured to receive the rib 140 of the cleat 128. A bottom edge of the trim panel 122 includes a recess 146 that is configured to receive a protrusion 148 formed on an upper edge of the uppermost panel 64. A gasket 150 is installed and compressed against surfaces defined by the recess 146 as the protrusion 148 is inserted into the recess 146 (FIG. 12B). The gasket 150 provides an added level of water ingress protection. A bottom edge of the trim panel 122 rests on an upper edge surface of the uppermost panel 64. An upper portion of the trim panel 122 includes a recess 152 that receives the upper portion 132 of the cleat 128. This recess can include locking teeth 170 (FIG. 12B) that mate with corresponding locking teeth 172 that are formed on an upper edge of the cleat 128. An additional cut-out portion 154 is also formed within the trim panel 122 to accommodate the fastener 136. In the example shown in FIG. 12B, the fastener 136 includes a rounded head 156 facilitates capturing the trim panel 122 in a head recess 158.

Figure 13:
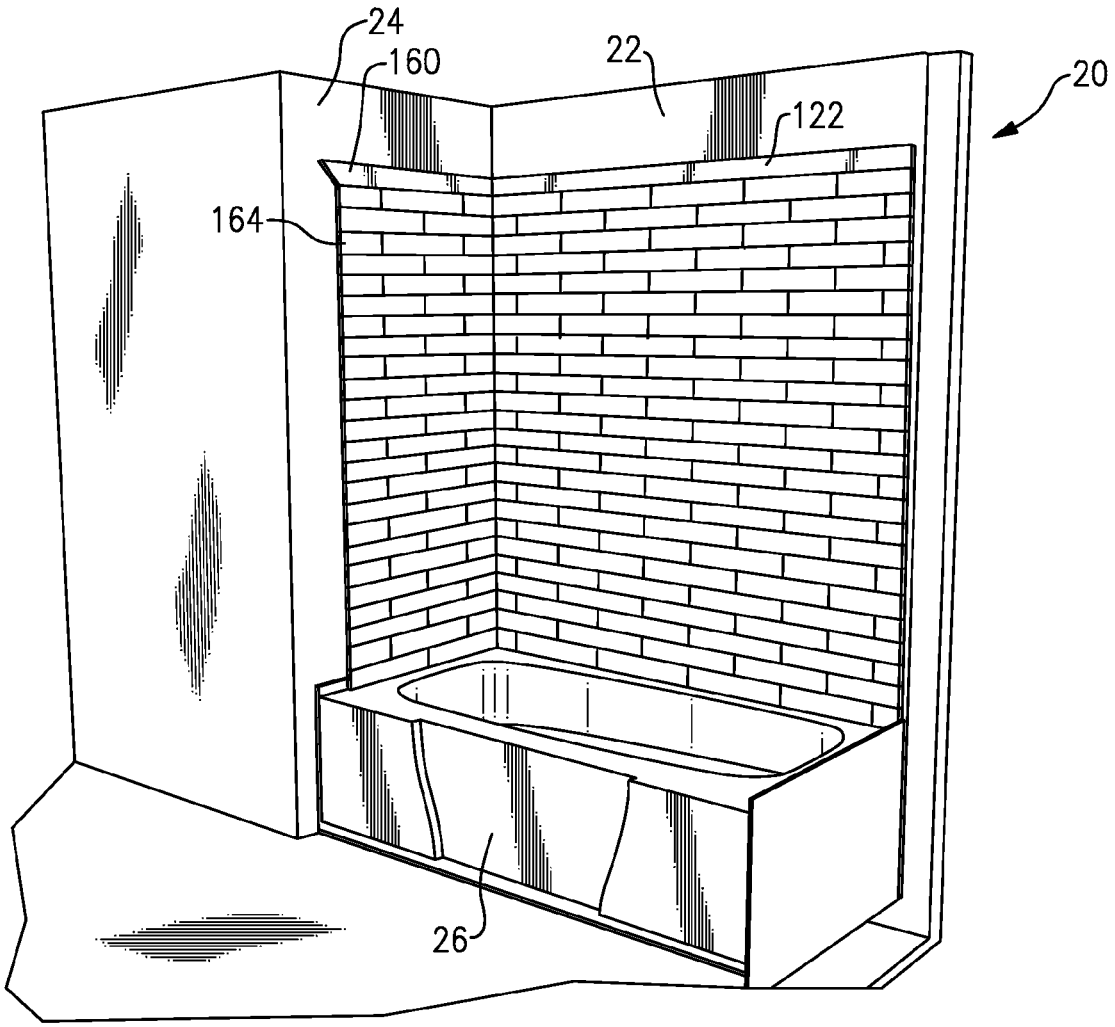
FIG. 13 is a view similar to FIG. 11 but additionally shows a horizontal trim piece along the side wall.
Figure 14:
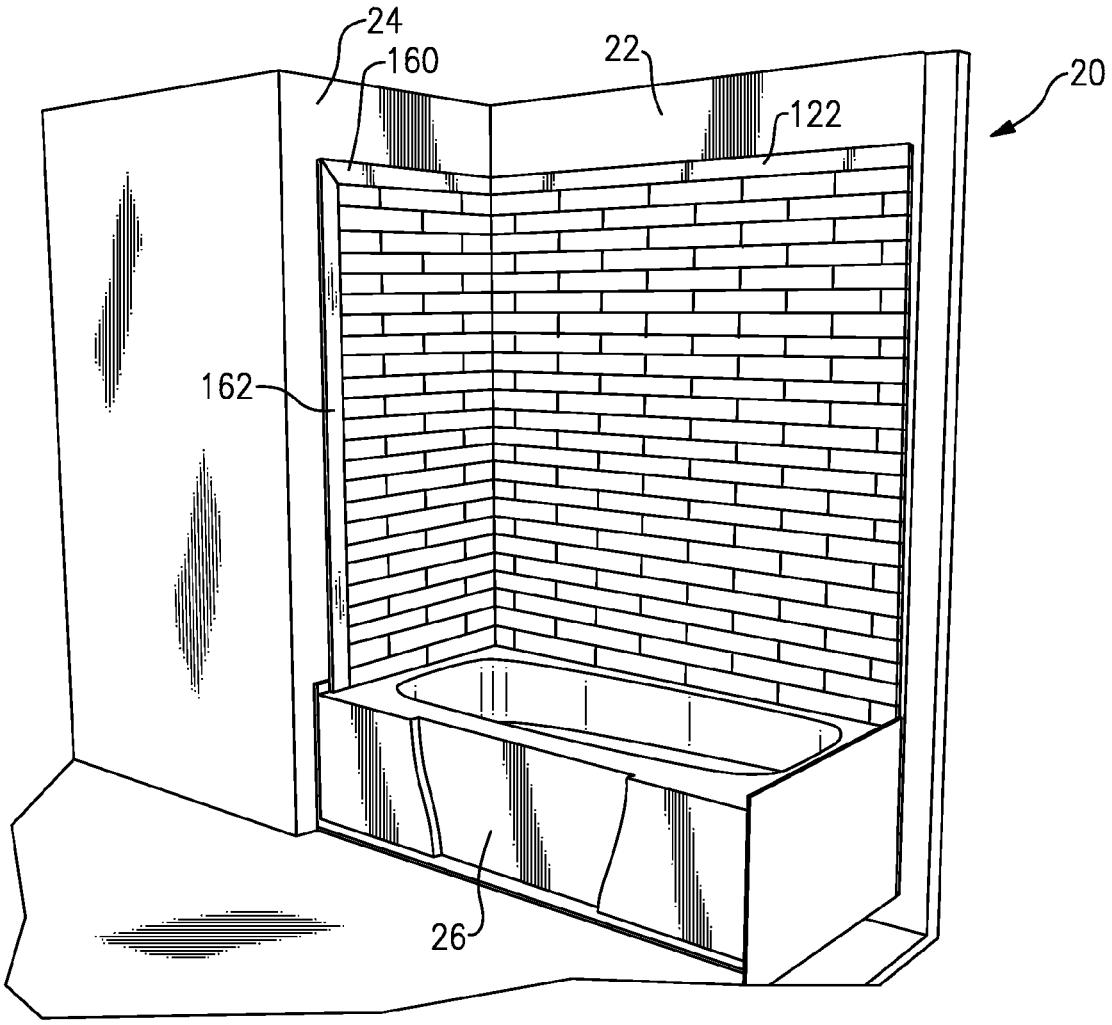
FIG. 14 is a view similar to FIG. 13 but additionally shows a vertical trim piece along a front edge of panels mounted to the side wall.
Figure 15A:
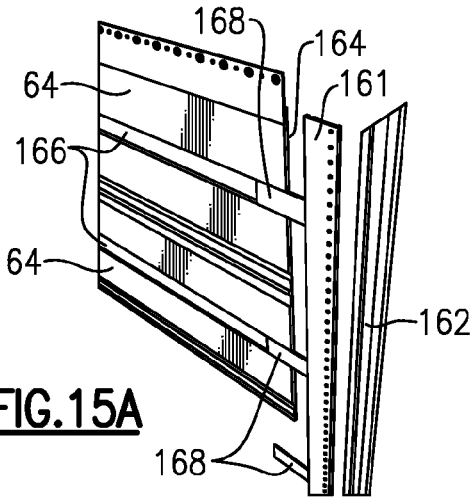
FIG. 15A is a perspective rear view of an intermediate installation position of the vertical trim piece.

Once the trim panel 122 is installed along the rear wall 22 (FIG. 11), a similar installation process is performed to install a trim panel 160 along the uppermost panel 64 on the side wall 24 as shown in FIG. 13. Next, vertical trim panels or pieces 162 are installed to cover outward facing edges 164 (FIG. 13) of the panels 64 on the side walls 24. As shown in FIG. 15A, one or more of the wall facing sides 78 of the panels 64 include a groove or slot 166. A vertical trim support piece 161 includes one or more extension portions or tabs 168 that are slid into the slot(s) 166 and then the vertical trim piece 162 can be attached to cover the outward facing edges 164 as shown in FIG. 14. A top portion of the vertical trim piece 162 abuts against the horizontal trim panel 122 to provide a finished look.

Figure 15B:
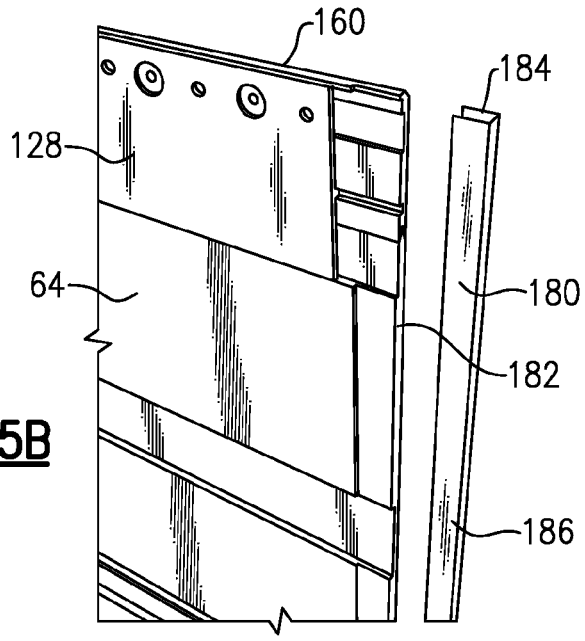
FIG. 15B is a perspective rear view of another example of a vertical trim piece in an uninstalled position.
Figure 15C:
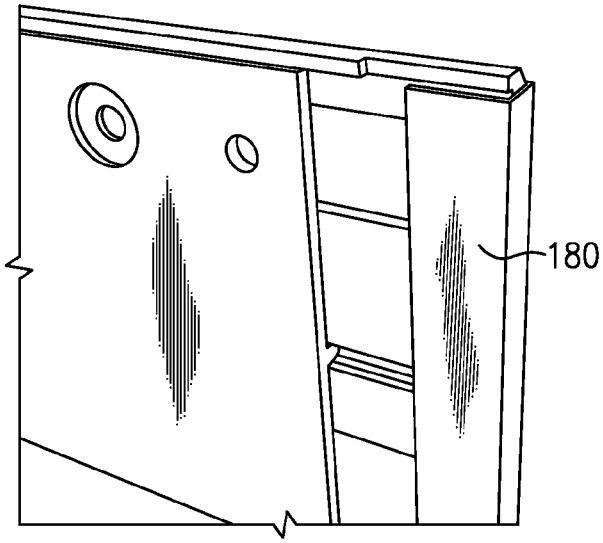
FIG. 15C is a view similar to FIG. 15B but showing the vertical trim piece in an installed position.

An optional vertical trim piece 180 is shown in FIGS. 15B-C. In this configuration the trim piece 180 comprises a C-shaped channel that is fit over the outer edge 182 of the panels 64. The trim piece 180 includes a bathing area portion 184 that fits over the exterior surface of the panels 64 and a rear portion 186 that fits behind the panel 64. Once the trim piece 180 is installed, it can be sealed with caulk.

Figure 17A:
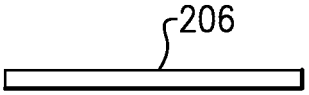
FIG. 17A is a schematic representation of a tile portion of a wall panel having a smooth surface.
Figure 17B:
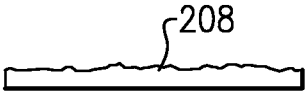
FIG. 17B is a schematic representation of a tile portion of a wall panel having a textured surface.

FIG. 16 shows a completed bathing area covered with a plurality of panels 200 that are configured to show an aesthetic of large tile pieces 202. One set of the panels 200 is formed to include an accent tile portion 204. Also, as shown in FIG. 17A, the panels can be configured such that sections of the panel have a smooth tile surface 206, or sections of the panel could be formed with a textured surface 208 as shown in FIG. 17B.

Figure 18B:
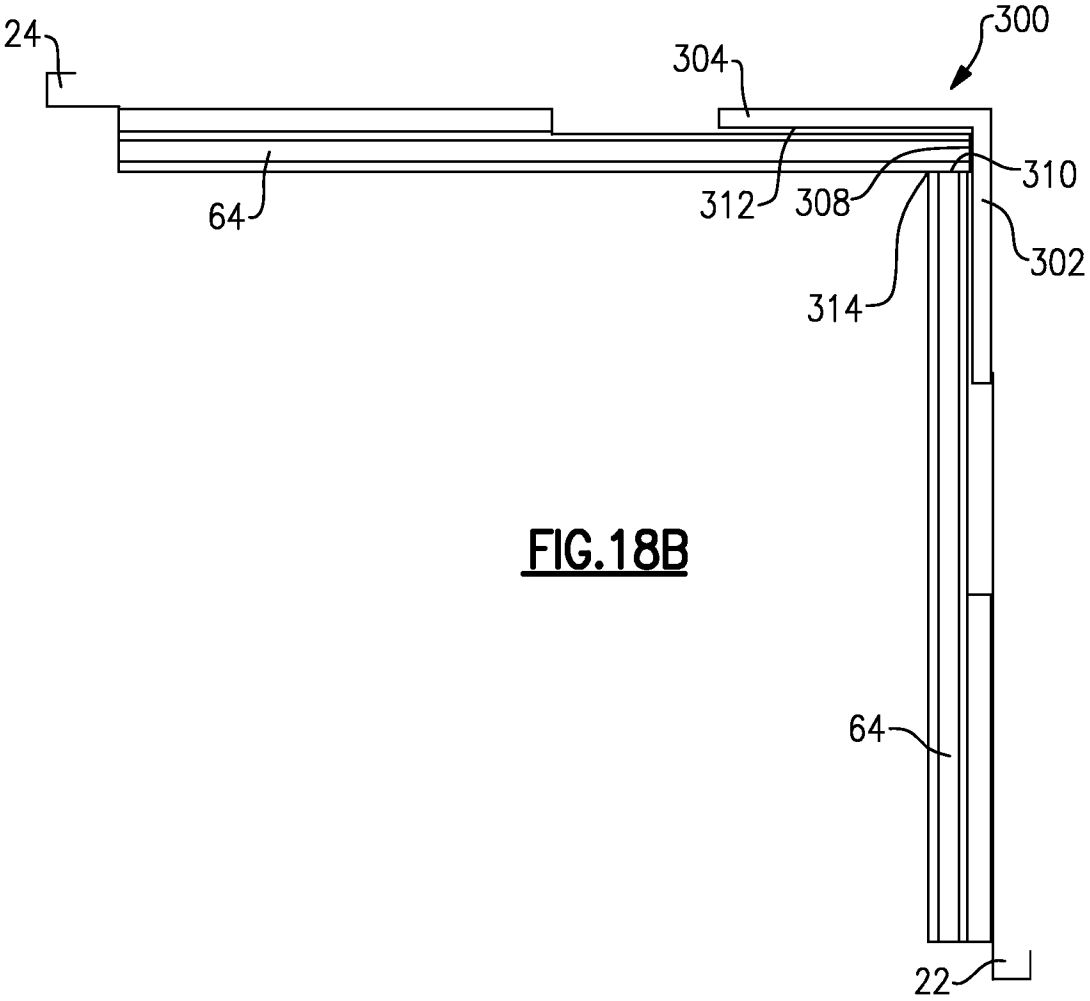
FIG. 18B is a top view of FIG. 18A.
Figure 18A:
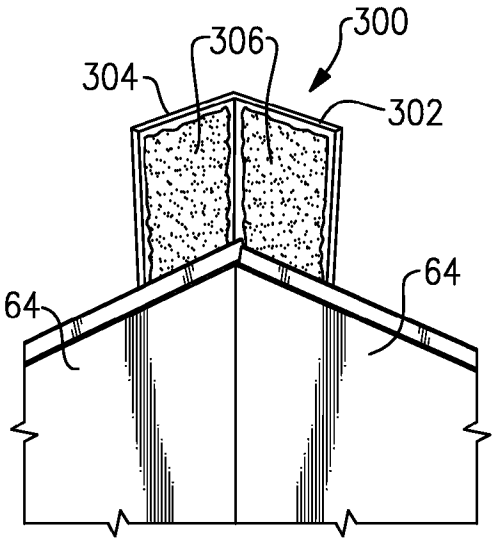
FIG. 18A is a front perspective view of another example of a corner detail.

As discussed above, the corner piece assembly 42 of FIG. 4 is just one example. An optional corner piece 300 is shown in FIGS. 18A-8B. This corner piece 300 comprises an L-shape having a rear wall portion 302 and a side wall portion 304 that abut against the starter strip 30 and cleats 102, 128. The wall portions 302, 304 can include adhesive 306 to aid in the installation process and to provide additional sealing. During installation, the panels 64 for the side wall 24 are installed such that they overlap the side wall portion 304 with a rear edge 308 surface abutting against the rear wall portion 302. The panels 64 for the rear wall 22 are installed such that the panels overlap the rear wall portion 302 with a side edge 310 abutting against the bathing area facing side 312 of the panel 64 on the side wall 22. Caulk 314 can be added at this interface as needed to provide extra sealing. This configuration provides a simple and light weight configuration, and facilitates hiding uneven edges of the back panels.

Figure 20B:
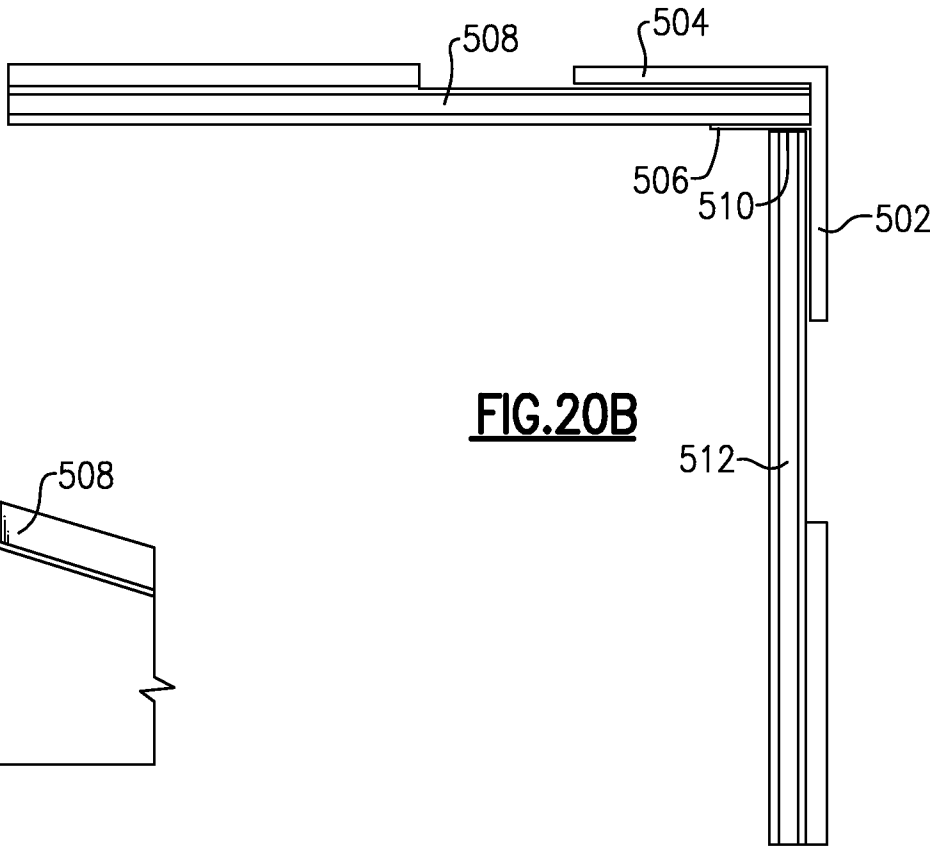
FIG. 20B is a top view of a corner detail from the embodiment of FIG. 20A.
Figure 20A:
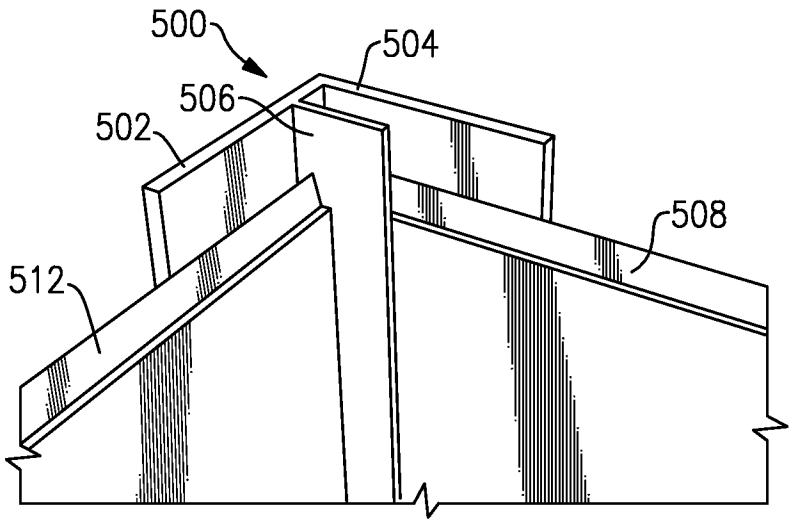
FIG. 20A is a front perspective view of another example of a corner detail.

Another example of an optional corner piece 500 is shown in FIGS. 20A-20B. In this example, the corner piece 500 comprises an "F-shape" having a side wall portion 502, a rear wall portion 504, and a flap portion 506 that extends outwardly from the side wall portion 502 to be spaced apart and generally parallel to the rear wall portion 504. The flap portion 506 has a reduced length compared to the rear wall portion 504. A back wall panel 408 is placed behind the flap portion 506 (FIG. 20B) and an edge 510 of a side wall panel 512 abuts against a forward facing side of the flap portion 506. The use of this configuration allows for the use of individual seals for each panel 508, 512. Another advantage with this configuration is that it allows for a large variance along edges of the cut back panels 508.

The panels 64 can be formed using any of various manufacturing process options. For example, a cosmetic panel could be extruded and decorated with film or could be decorated using hydro-graphics. In another example, a non-cosmetic back panel could be extruded with a cosmetic panel being bonded to the back panel. The cleats 102, 128 could be bonded to the back panel, or extruded as part of the back panel as described above. Further, as discussed above, the cosmetic portion of the panels can be formed as patterns for stone, marble, and granite. Wood grain patterns, photographic images, metallic finishes, etc. could also be provided.

Figure 19:
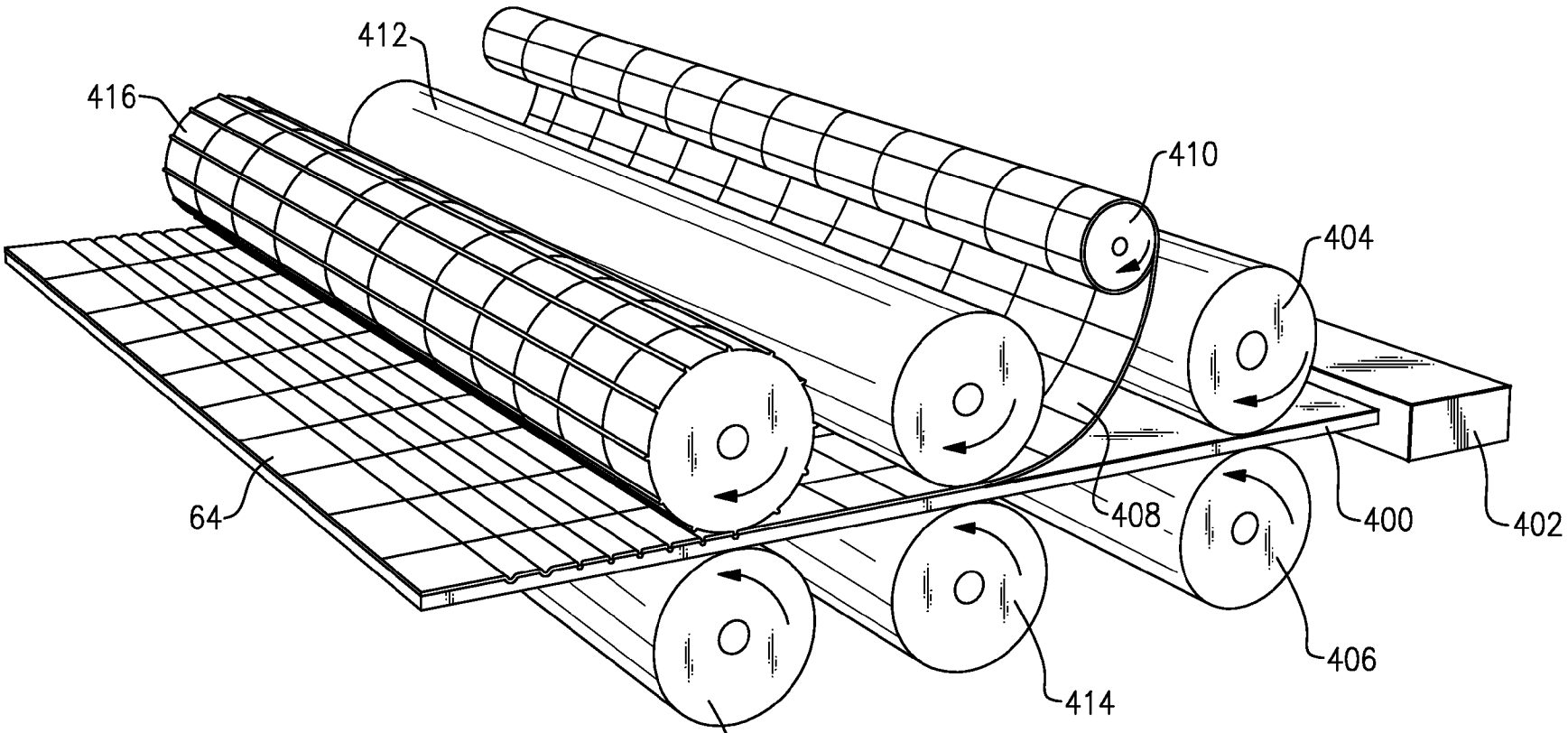
FIG. 19 is a schematic representation of one example of a panel extrusion process.

The panels can be fabricated using any of various methods. One example manufacturing method is shown in FIG. 19. An extruded panel 400 is formed by an extrusion die 402 between a panel extrusion drum press 404 and a first idler drum 406. Next a graphic film 408 is applied from a graphic film roll 410 after the panel exits the extrusion drum press 404. The graphic film 408 is applied to the panel 400 via a graphic film drum press 412 and a second idler drum 414. Then the panel with the graphic film applied passes between a tile texture drum press 416 and a third idler drum 418 to provide the desired tile graphic configuration. The finished panel 64 can then be cut to a desired length.

In another example, the panel could be molded.

The wall installation system described above provides a bathing area surround that is easy to transport, is simple to install and easy to check, while also being fully functional and providing an aesthetically appealing appearance. The system utilizes the series of planks or panels to interlock with each other, while small gaskets are mounted within each panel section to create a waterproof barrier. Over the life of the system, the panel construction allows for easy plumbing access without necessitating the demolition of an entire unit. Further, panels can be easily removed and replace during remodeling.

Further, while the wall installation system is disclosed as being used for a bathing area surround, the wall installation could also be used for walls in other rooms such as kitchens, family rooms, etc. Also, for example, the wall installation could be used for countertops, backsplashes, etc.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A wall system comprising:

at least one starter piece including at least one mount interface configured to be attached to a wall structure;

a plurality of panels including at least a first panel and a second panel wherein the first panel is fit to the starter piece such that a wall facing side of the first panel is flush with a wall facing side of the starter piece to cover a portion of the wall structure, and wherein a front facing side of the starter piece faces the wall facing side of the first panel; wherein the starter piece comprises a starter strip that includes at least one first locating feature and the first panel includes at least one second locating feature that cooperates with the first locating feature to align and interlock the first panel and the starter strip;

at least one seal between the starter piece and the first panel, wherein one of the starter piece and the first panel includes a groove and the other of the starter piece and the first panel includes a protrusion, and wherein the seal is positioned in the groove and is compressed by insertion of the protrusion into the groove;

an intermediate cleat associated with the first panel, wherein the decorative external surface of the first panel comprises a visible decorative surface that extends from an upper edge of the first panel to a lower edge of the first panel, and wherein an upper portion of the wall facing side has a cut-out such that a lower edge of the intermediate cleat is positioned between the wall structure and the upper portion of the first panel; and the second panel is associated with the first panel via the intermediate cleat such that decorative external surfaces of the first and second panels align with each other to cover another portion of the wall structure.

2. The wall system according to claim 1 wherein the decorative external surfaces cooperate to form a desired aesthetic appearance for walls surrounding a bathing area.

3. The wall system according to claim 2 wherein the decorative external surfaces are smooth.

4. The wall system according to claim 2 wherein the decorative external surfaces are textured.

5. The wall system according to claim 1 wherein the intermediate cleat is one of integrally formed with the first panel or separately attached to the first panel, and wherein the intermediate cleat includes at least one cleat mount interface for attachment to the wall structure, and wherein an upper portion of the first panel is fit to a lower portion of the intermediate cleat and an upper portion of the intermediate cleat is fit to a lower portion of the second panel.

6. The wall system according to claim 5 wherein the at least one cleat mount interface includes at least one fastener extending through the cleat to fix the intermediate cleat to the wall structure.

7. The wall system according to claim 6 wherein the first and second panels completely cover the fastener and the intermediate cleat.

8. The wall system according to claim 1 wherein one of the first and second locating features comprises a tongue and the other of the first and second locating features comprises a groove.

9. The wall system according to claim 1 wherein the at least one mount interface comprises an opening, and including a fastener extending through the opening to fix the starter piece to the wall structure.

10. The wall system according to claim 1 wherein the starter piece comprises a starter strip, and wherein the at least one mount face comprises a plurality of openings, and wherein at least one of the openings is larger than the remaining openings to allow for vertical adjustment of the starter strip to a level position.

11. The wall system according to claim 1 wherein the intermediate cleat includes at least one first locating feature and the second panel includes at least one second locating feature that cooperates with the first locating feature to align the second panel to the intermediate cleat.

12. The wall system according to claim 11 wherein the second panel includes a wall facing side and the decorative external surface that comprises a visible decorative surface that extends from an upper edge of the second panel to a lower edge of the second panel, and wherein a lower portion of the wall facing side of the second panel has a cut-out with an upper edge of the intermediate cleat being positioned between the wall structure and the lower portion of the second panel such that the visible decorative surfaces of the first and second panels align with each other.

13. The wall system according to claim 11 including at least one seal between the first and second panels.

14. The wall system according to claim 1 wherein the plurality of panels cooperate with each other to cover bathroom walls that surround a bathing area, and wherein the plurality of panels includes at least one uppermost panel, and further including another cleat fit to the uppermost panel and a horizontal trim piece that is fit to the uppermost panel to cover the cleat fit to the uppermost panel, and wherein the starter piece comprises a lowermost portion of the bathroom walls.

15. The wall system according to claim 14 wherein the plurality of the panels are aligned to provide at least one exposed vertical edge, and further including at least one vertical trim piece that is coupled to at least one of the plurality of panels that form the vertical edge, and wherein the vertical trim piece abuts against the horizontal trim piece and covers the exposed vertical edge.

16. The wall system according to claim 1 wherein the plurality of panels cooperate with each other to cover bathroom walls that surround a bathing area, the bathroom walls including a rear wall and at least one side wall that intersects the rear wall at a corner, and wherein the plurality of panels includes at least one first corner panel covering a portion of the rear wall and a second corner panel covering a portion of the side wall, and further including at least one corner piece that is fit within the corner and which abuts against the first and second corner panels.

17. The wall system according to claim 1 wherein the plurality of panels cooperate with each other to cover bathroom walls that surround a bathing area, the bathroom walls including a rear wall and at least one side wall that intersects the rear wall at a corner, and wherein the at least one starter piece comprises at least one first starter strip associated with the rear wall and a second starter strip associated with the side wall, and further including an intermediate starter strip corner piece that fits within the corner and abuts against the first and second starter strips.

18. A method of covering walls that surround an area comprising the steps of:

(a) installing at least one starter piece;

(b) fitting at least one first panel of a plurality of panels to the starter piece such that a wall facing side of the first panel is flush with a wall facing side of the starter piece to cover a portion of a wall structure, and such that a front facing side of the starter piece faces the wall facing side of the first panel; wherein the starter piece comprises a starter strip that includes at least one first locating feature and the first panel includes at least one second locating feature that cooperates with the first locating feature to align and interlock the first panel and the starter strip;

(c) providing one of the starter piece and the first panel with a groove and the other of the starter piece and the first panel with a protrusion, and positioning a seal in the groove and compressing the seal by insertion of the protrusion into the groove;

(d) associating an intermediate cleat with the first panel; and (e) associating at least one second panel of the plurality of panels with the intermediate cleat and the first panel to cover another portion of the wall structure.

19. The method according to claim 18 including forming the first and second panels to have a visible decorative outer surface that is at least one of a smooth or textured surface.

20. The method according to claim 18 including installing panels until a specified wall area of bathroom walls surrounding a bathing area is completely covered.

21. The method according to claim 18 including installing the plurality of panels on walls until a specified area is covered, and including installing at least one horizontal trim piece to cover an exposed uppermost edge formed by the plurality of panels.

22. The method according to claim 21 including installing at least one vertical trim piece to cover an exposed vertical edge formed by the plurality of panels.

23. The wall system according to claim 1 wherein the seal is completely enclosed within an internal recess formed within one of the starter piece and first panel.

24. The wall system according to claim 1 wherein a wall facing side of the second panel is flush with a wall facing side of the intermediate cleat.

25. The wall system according to claim 24 wherein the wall facing side of the second panel is flush with the wall facing side of the first panel.

26. The wall system according to claim 1 wherein the wall facing side of the first panel includes a cut-out that receives the starter piece.

27. The wall system according to claim 1 wherein the starter piece includes a horizontally extending base with a vertically extending protrusion, and wherein a lower edge of the first panel includes a groove that receives the protrusion, and wherein the seal is compressed by the protrusion to be completely enclosed within the groove.

28. The wall system according to claim 17 wherein the intermediate starter strip includes a rear wall portion and a sidewall portion, and wherein a vertically extending edge of the rear wall portion abuts directly against a vertically extending edge of the first starter strip such that an external facing side of the rear wall portion is flush with an external facing side of the first starter strip, and wherein a vertically extending edge of the side wall portion abuts directly against a vertically extending edge of the second starter strip such that an external facing side of the side wall portion is flush with an external facing side of the second starter strip.

29. The wall system according to claim 16 wherein the corner piece includes a mounting structure such that the first and second corner panels abut directly against each other to form the corner.

30. The wall system according to claim 1 wherein a lower edge of the first panel is fit to a lower portion of the starter piece and a lower portion of the second panel is fit to an upper portion of the first panel such that the decorative external surfaces of the first and second panels are flush with each other to form a portion of a bathroom wall with a desired aesthetic appearance.

* * * * *